US009868203B2

(12) United States Patent
Ursell et al.

(10) Patent No.: US 9,868,203 B2
(45) Date of Patent: Jan. 16, 2018

(54) WORK AND STORAGE TABLE

(71) Applicant: Affinity Tool Works, LLC, Troy, MI (US)

(72) Inventors: Mike Ursell, Bloomfield Hills, MI (US); Connor Ursell, Bloomfield Hills, MI (US); Mark Cross, Marysville, MI (US); Sam Ursell, Beverly Hills, MI (US); Ken Neilson, Troy, MI (US)

(73) Assignee: Affinity Tool Works, LLC, Troy, MI (US)

( * ) Notice: Subject to any disclaimer, the term of this patent is extended or adjusted under 35 U.S.C. 154(b) by 0 days.

(21) Appl. No.: 15/015,366

(22) Filed: Feb. 4, 2016

(65) Prior Publication Data

US 2016/0221176 A1 Aug. 4, 2016

Related U.S. Application Data

(60) Provisional application No. 62/111,724, filed on Feb. 4, 2015, provisional application No. 62/218,174, filed on Sep. 14, 2015.

(51) Int. Cl.

| | |
|---|---|
| ***B25H 3/00*** | (2006.01) |
| ***B25H 1/04*** | (2006.01) |
| ***B25H 1/14*** | (2006.01) |

(52) U.S. Cl.

CPC ..... *B25H 1/04* (2013.01); *B25H 1/14* (2013.01); *B25H 3/00* (2013.01)

(58) Field of Classification Search

CPC ... B25H 1/10; B25H 1/02; B25H 1/04; B25H 1/14; B25H 3/00; B23D 47/025; B23D 59/007; B27B 5/16; A47B 1/04

USPC ..... 108/12, 13, 77, 80–82, 6, 8; 312/313, 312/315, 316, 317.3; 144/286.1, 286.5, 144/136.95, 218, 135.2, 145.2; 280/43.14; 83/563, 568, 601, 605; 269/290, 292, 308, 309; 409/228, 229, 409/206, 185

See application file for complete search history.

(56) References Cited

U.S. PATENT DOCUMENTS

| | | | | | |
|---|---|---|---|---|---|
| 2,546,816 | A * | 3/1951 | Benvissuto | A47B 3/0815 | 108/130 |
| 2,607,947 | A * | 8/1952 | Tiffany | A47B 31/00 | 108/80 |
| 2,727,799 | A * | 12/1955 | Keal | A47B 9/18 | 108/102 |
| 2,743,747 | A * | 5/1956 | Franks | B27C 9/02 | 144/286.5 |
| 3,862,686 | A * | 1/1975 | Kolarik | B25H 1/04 | 190/11 |
| 4,320,678 | A * | 3/1982 | Volk | B23D 49/162 | 269/87.2 |

(Continued)

*Primary Examiner* — Janet M Wilkens

(74) *Attorney, Agent, or Firm* — William H. Honaker; Dickinson Wright PLLC

(57) ABSTRACT

A tool support table having a support frame having opposed sides. A two sided work top mounted between the opposed sides of the support frame for rotation with respect to the support frame. The work top has a flat surface on one side and a tool support surface on the opposite side. The work top is rotatable with respect to the support frame to expose the flat surface or the tool support surface. The tool support table is generally cuboid shaped. The tool support table also includes a unique universal tool mount.

10 Claims, 8 Drawing Sheets

(56) References Cited

U.S. PATENT DOCUMENTS 4,465,114 A * 8/1984 Schumacher ..... B23D 47/04 108/8
4,639,005 A * 1/1987 Birkley ..... B27B 5/10 280/43.14
4,647,028 A * 3/1987 Yang ..... B25B 1/10 269/139
4,733,704 A * 3/1988 Wolff ..... B23D 47/025 108/159
5,694,994 A * 12/1997 Engler, III ..... B27C 5/02 144/134.1
5,715,880 A * 2/1998 Tucker ..... B23Q 3/002 144/134.1
5,863,052 A * 1/1999 Roman ..... B23D 47/025 144/286.1
5,884,681 A * 3/1999 Nickles ..... B23D 47/025 144/286.1
6,488,256 B1 * 12/2002 Chang ..... B23D 47/02 248/346.03
7,089,980 B2 * 8/2006 Rulli ..... B25H 1/12 144/286.1
7,690,408 B2 * 4/2010 Sugiura ..... B25H 1/04 144/286.5
8,584,564 B2 * 11/2013 Welsh ..... B23D 47/025 144/286.1
9,156,486 B2 * 10/2015 Liu ..... B62B 1/12
9,290,050 B2 * 3/2016 Chang ..... B27B 5/10
9,403,224 B1 * 8/2016 Silva ..... B23D 45/044
2002/0104463 A1 * 8/2002 Wichert ..... B25H 1/10 108/13
2005/0034783 A1 * 2/2005 Laird ..... B25H 1/04 144/286.5
2006/0038383 A1 * 2/2006 Wu ..... B25H 1/04 280/652
2006/0201296 A1 * 9/2006 Kuo ..... B27B 27/08 83/435.12
2006/0213578 A1 * 9/2006 Haag ..... B25H 1/10 144/287
2008/0099104 A1 * 5/2008 Bradley ..... B27C 5/02 144/286.5
2009/0078165 A1 * 3/2009 Tseng ..... A47B 3/0912 108/6
2010/0229767 A1 * 9/2010 Chiu ..... A47B 31/04 108/115
2011/0232805 A1 * 9/2011 DeSpain ..... B25H 1/04 144/285
2012/0152155 A1 * 6/2012 Healy ..... B25H 1/04 108/50.11
2013/0285302 A1 * 10/2013 Helm ..... B25H 1/04 269/17
2015/0108418 A1 * 4/2015 Chang ..... B27B 5/10 254/418

* cited by examiner

WORK AND STORAGE TABLE

CROSS REFERENCE TO RELATED APPLICATION

This application claims the benefit of U.S. Provisional Application No. 62/111,724 filed Feb. 4, 2015, and U.S. Provisional Application No. 62/218,174 filed Sep. 14, 2015, which are incorporated herein by reference in their entirety.

BACKGROUND OF THE INVENTION

The present invention generally relates to a work bench which can also function as a tool support stand. Work benches and tool support stands are well known but typically separate products. Work benches come in many shapes and sizes but generally do not easily support most power tools that are intended to be mounted. Workbenches tend to have a large wide flat surface upon with a user can work on a project. They can have fixed or adjustable legs and may be stationary or transportable. By contrast, tool support stands generally employ a top surface which is generally narrow to which a tool, such as a saw, can be mounted and legs to support the stand. These tool support stands come in any number of sizes and shapes, but typically have four legs that are fixed in the support position or can be individually folded or telescoped to a closed position. Some of these known tool support stands also include extendable work surfaces that can be pulled out to make the overall length of the tool stand longer.

Examples of applicant's tool support stands can be found in U.S. Design Pat. Nos. D623,672 and D549,749.

The difficulty with typical tool support stands is that they can be large and unwieldy. If the legs are fixed in place, it can be difficult to move the tool stand from job to job. This is true even if wheels are provided to roll the tool stand. Folding legs and extendible legs can be cumbersome. Each leg has to be extended or folded out to use the stand and collapsed to transport the stand. Additionally, the tool support stands do not make ideal work benches, the tool support stands are too narrow to truly function as a good work bench.

Another problem with typical tool support stands is that the tool mounted to the support stand has to be removed for storage. The stands leave the tool exposed, there is not place on the stand to store the tools What is needed is a versatile, multipurpose tool stand and work bench that can be easily and quickly changed from a tool support to a workbench and provide storage for the tool. Additionally, the tool stand and work bench should be compact, but still provide the desired work area when needed.

SUMMARY OF THE INVENTION

In general terms, this invention provides a unique cuboid shaped work and storage table that has a rotatable top that exposes a work surface on one side and a unique universal tool mount on the opposite side.

The work and storage table of the present invention includes a support frame having opposed sides with a two sided work top mounted between the opposed sides of the support frame for rotation with respect to the support frame. The work top has a flat surface on one side and a unique tool support surface on the opposite side. The work top can be rotated with respect to said support frame to expose the flat surface or the tool support surface. When that flat surface is exposed, any tool mounted to the tool support surface is stored underneath between the opposed sides. For compactness, the tool support table has a generally cuboid shape.

The work and storage table has a unique latch mechanism to lock the work top in place. The latch has a control disc from which locking rods extend and connect to pins that engage slots in the work top. The latch mechanism includes a handle that can be extended through the support frame. When not in use, the handle rest in a slot so that it doesn't obstruct the work surface. The handle is connected to the control disc such that the locking rods can be controlled from one locking handle. In the disclosed embodiment, locking rods extend along the length of said support frame to lock the work top at the front and back.

The work and storage table also includes a unique tool mount fixed to said tool support surface. The tool mount has at least two side walls and two tool mount slides mounted generally perpendicular to said side walls for sliding with respect to said side walls. The tool mount slides are adapted to attach to a tool and then mount to the two side walls. The unique tool mount provides a universal mount that can be used to mount any tool regardless of the configuration of the tool base, i.e. whether three point, four point and offset configuration.

The work and storage table also includes side arms hinged to the opposed sides that rotate from a lowered position to a raised position. The side arms include a height adjustable secondary platform mounted upon a parallelogram such that the platform remains generally parallel when adjusted.

These and other features and advantages of this invention will become more apparent to those skilled in the art from the detailed description of a preferred embodiment. The drawings that accompany the detailed description are described below.

DETAILED DESCRIPTION

Figure 1:
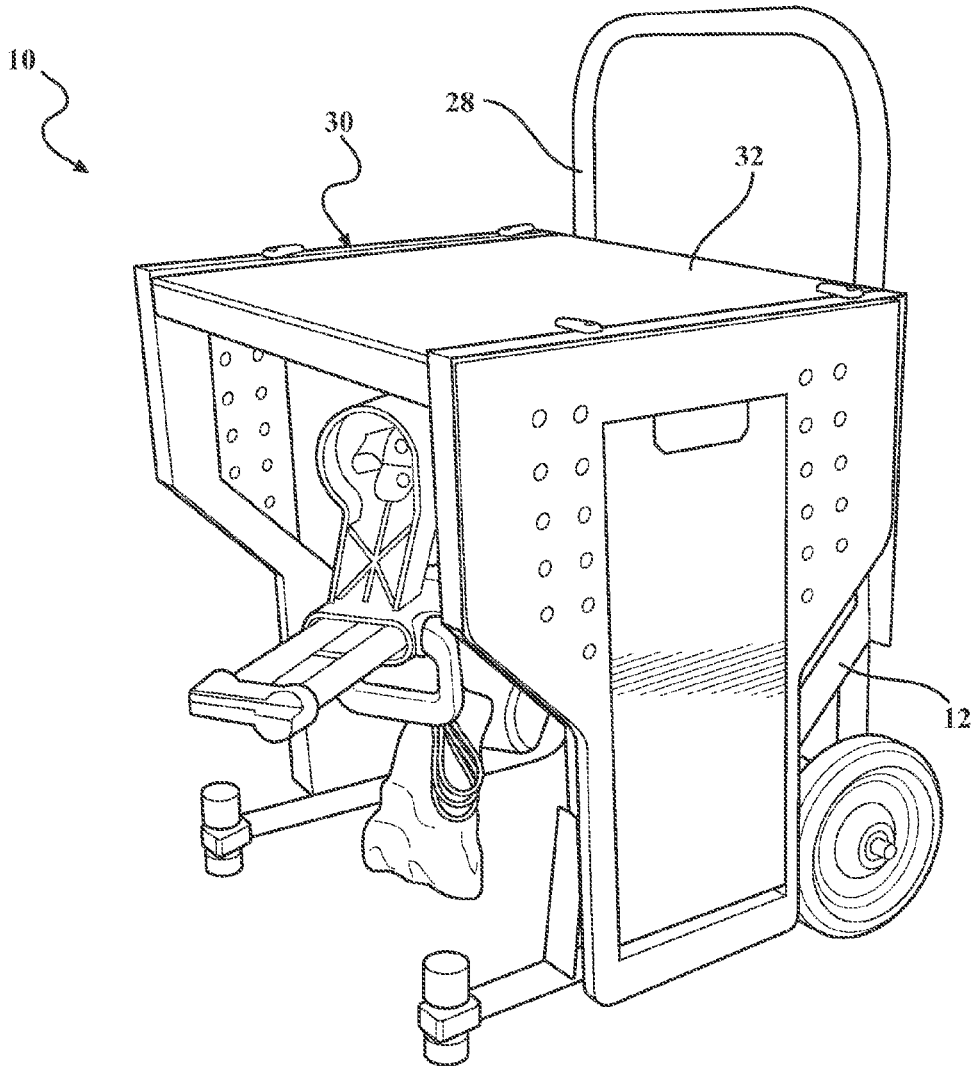
FIG. 1 is a perspective view of the tool support table of the present invention in the storage position.
Figure 2:
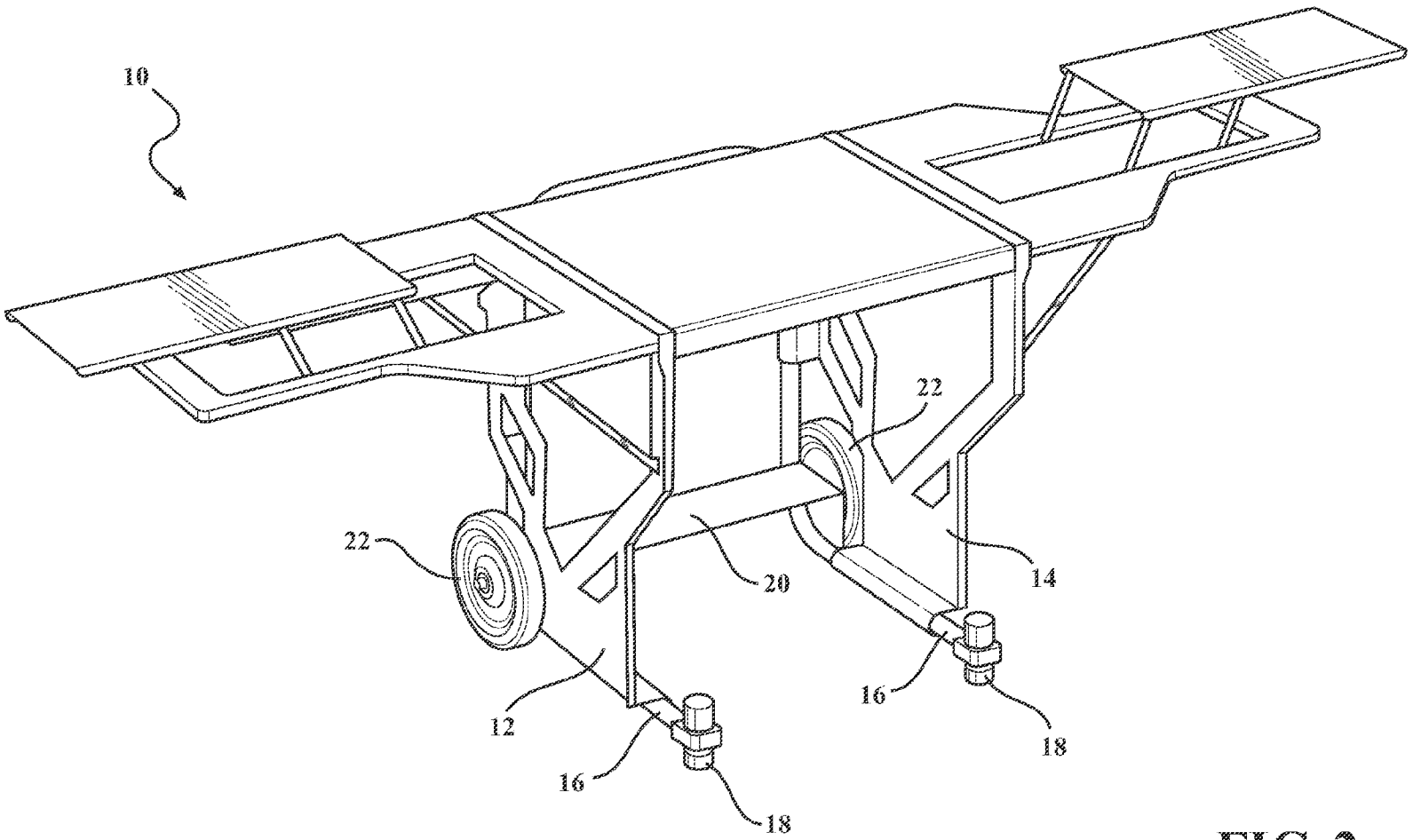
FIG. 2 is a perspective view of the tool support table of the present invention in the use position with the side arms rotated to the use position and the platforms raised.

The present invention relates to a tool support table and workbench combination generally shown at 10. The disclosed tool support table includes a frame having opposed sides, 12 and 14, a rear lower brace 20 and lower support tubes 16. Wheels 22 are mounted to the lower brace 20 at the opposed sides 12 and 14. The wheels 22 facilitate easy movement of the table 10. The lower support tubes 16 also include front stops 18 to support the table 10 in the upright position. As can be seen, the table 10 is a compact cuboid shape. As illustrated in FIG. 1, the tool is in the stored position and the work surface 30 is exposed. Due to the cuboid shape of the table 10, and the general height, the work surface 30 can be positioned against a standard work bench and create an extension to the overall work surface.

Extending up the back of the table 10 are opposed back support tubes 24. In the disclosed embodiment, the back support tubes 24 are integrally formed with the lower support tubes 16. Each one of the pair of the back tubes 24 and lower support tubes 16 are one single generally L-shaped tube extending from the back of the table 10 to the lower or bottom of the table 10. It will be appreciated by those of ordinary skill in the art that the back and lower support tubes 24 and 16 could be separate tubes.

Each of the back support tubes 24 have a lower stop 26. The stops 26 support the table 10 when the table 10 is placed on its back for storage. As should be appreciated by those of skill in the art, the width of the table 10 of the present invention allows the table 10 to be placed on its back on stops 26 and slid under a normal height standard work bench. A handle 28 is mounted within the tubes 24. The handle 28 is mounted so that it can slide within the tubes 24 from a use position to a storage position. It should be appreciated that the handle 28 could also be hinged to the back support tubes 24 so that it can be folded rather than slid with respect to tube 24.

A two sided worktop or rotating work surface 30 is mounted to the top of the opposed sides 12 and 14. In the disclosed embodiment, the surface 30 is mounted at its midpoint to the sides 12 and 14. This allows for controlled rotation of the surface 30. In the disclosed embodiment, the surface 30 is mounted to the sides 12 and 14 through pins 31. It should be appreciated that spring assists could be used to further facilitate rotation. The surface 30 has two sides, a flat work top 32 and a tool support 34. In the position illustrated in FIG. 1, the flat worktop 32 is flush with the two sides 12 and 14 and open to the front and back of the table 10 to allow use of the work top 32 when placed adjacent to a work bench. As will be appreciated, the worktop 32 acts as an extended work surface.

Figure 4:
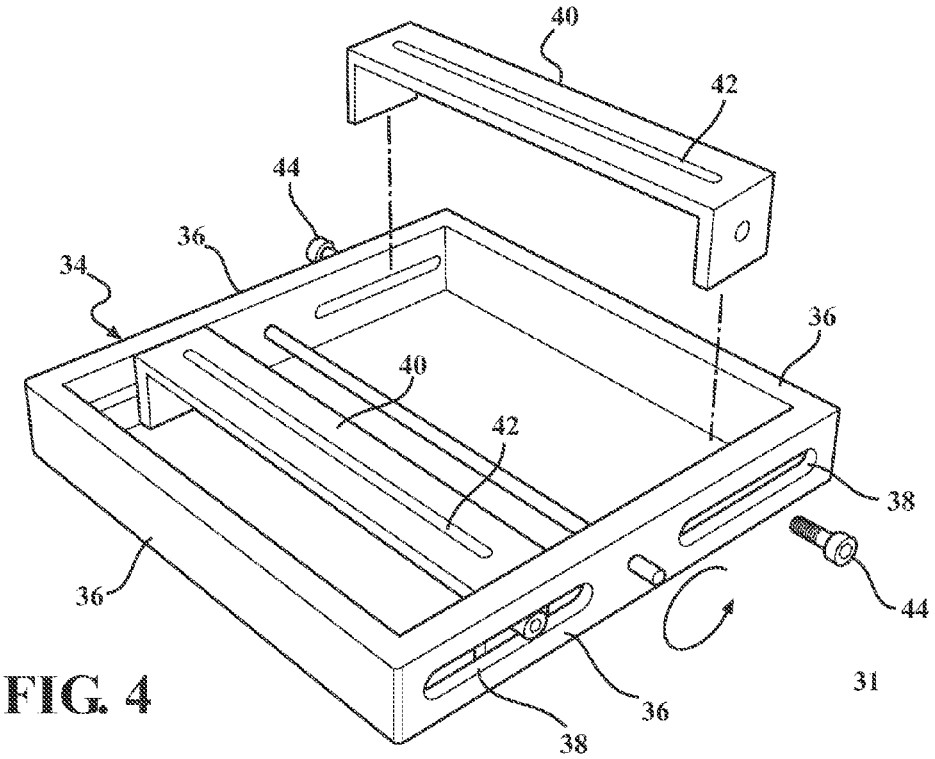
FIG. 4 is a perspective view of the tool support of the present invention.
Figure 9:
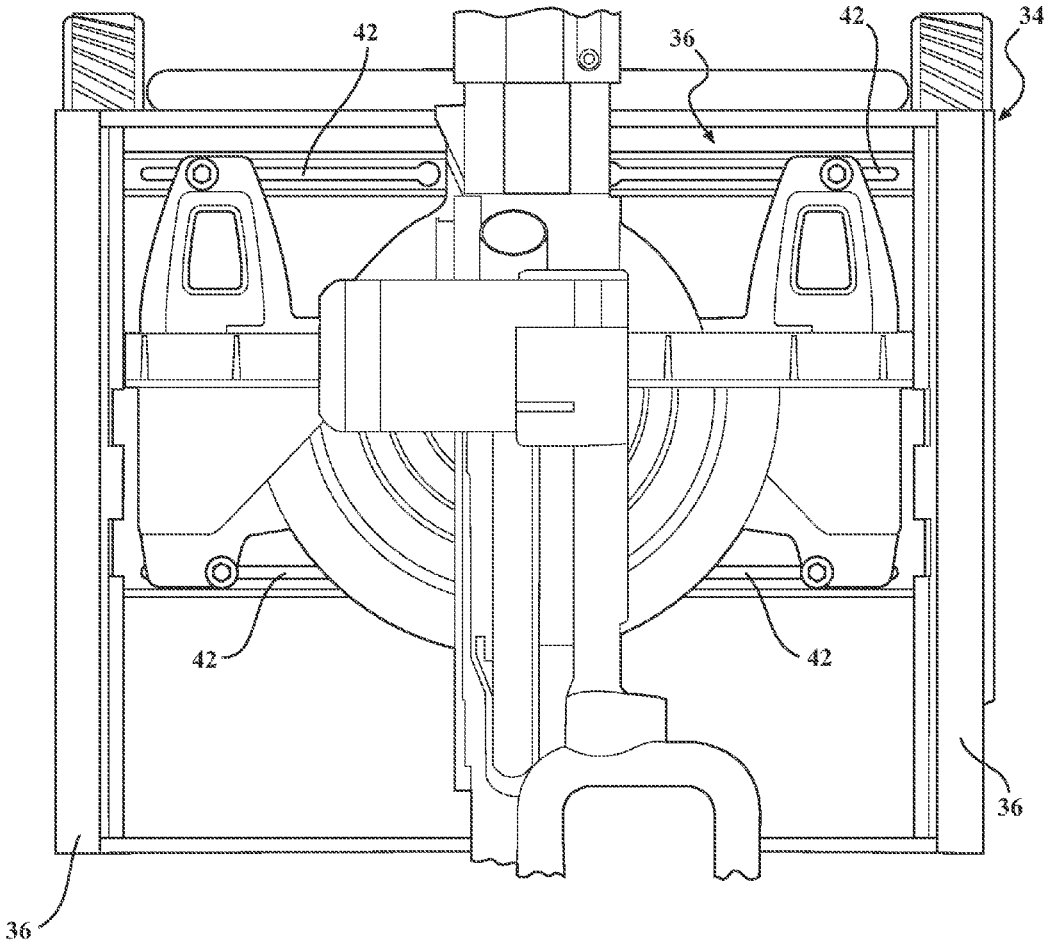
FIG. 9 is a top view of the tool mount of the present invention.
Figure 10:
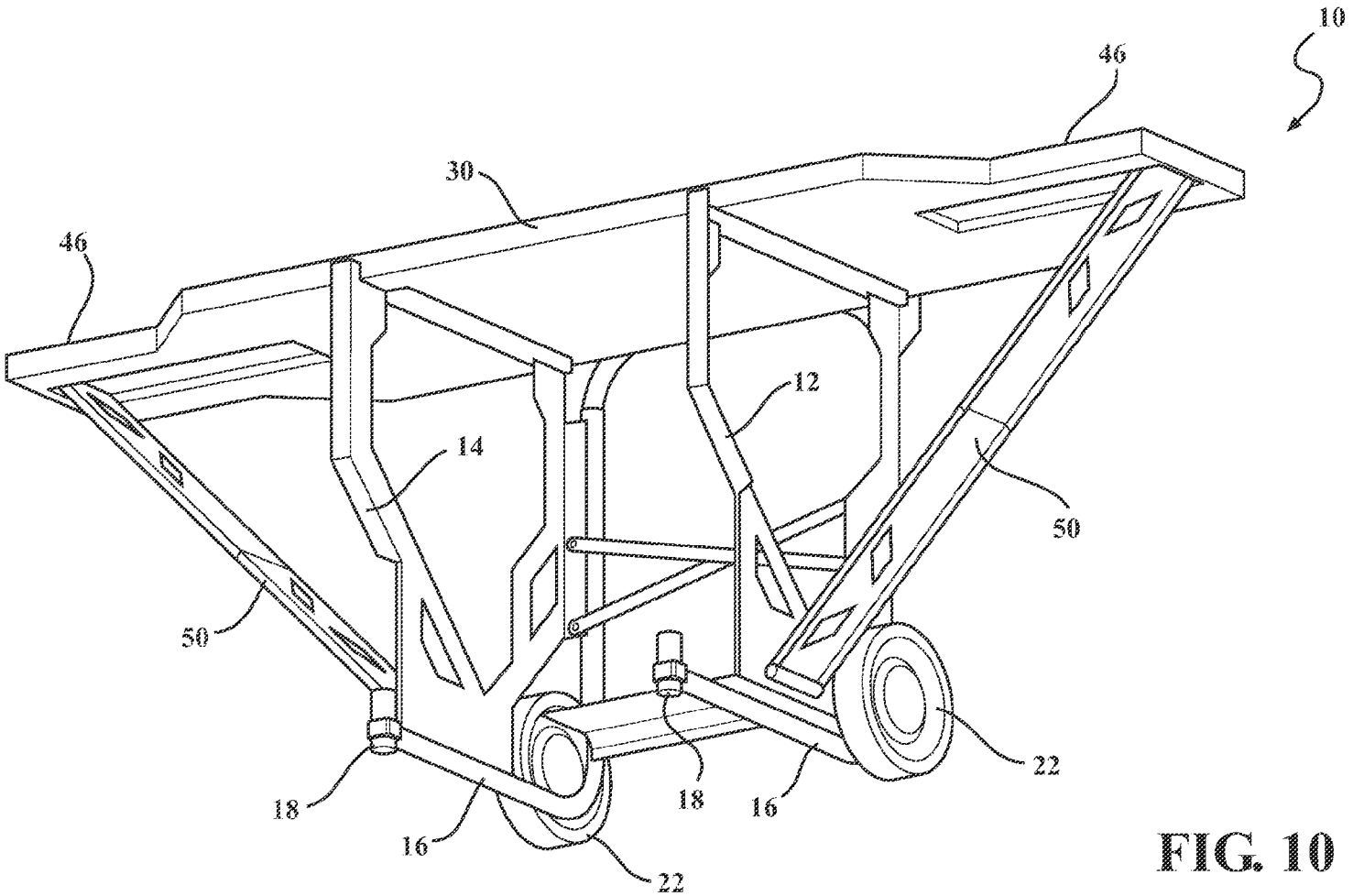
FIG. 10 is a perspective view of the tool support table of the present invention as viewed from the bottom.

With reference to FIGS. 4 and 9, the tool support 34 is defined by sides 36. Two of the opposed sides 36 have spaced slots 38. A pair of sliding tool mounts 40 are mounted within the two opposed sides through the slots 38. Each of the tool mounts 40 has a slot 42 that extends generally perpendicular to the spaced slots 38. The tool mounts 40 are mounted within the spaced slots 38 by fasteners 44, such as for example threaded bolts. The tool mounts 40 can slide within the slots 38. In this way, a tool, such as a saw can be mounted to the slots 42 and the tool mounts 40 can be mounted to the opposed sides 36 through the spaced slots 38 and fasteners 44. In this way, the tool support is universal and can fit any tool. The tool mounts 40 are perpendicular to for example the saw blade of the tool which allows the tool to be mounted without offset brackets or 3 point mounting bars, see FIG. 9.

Figure 5:
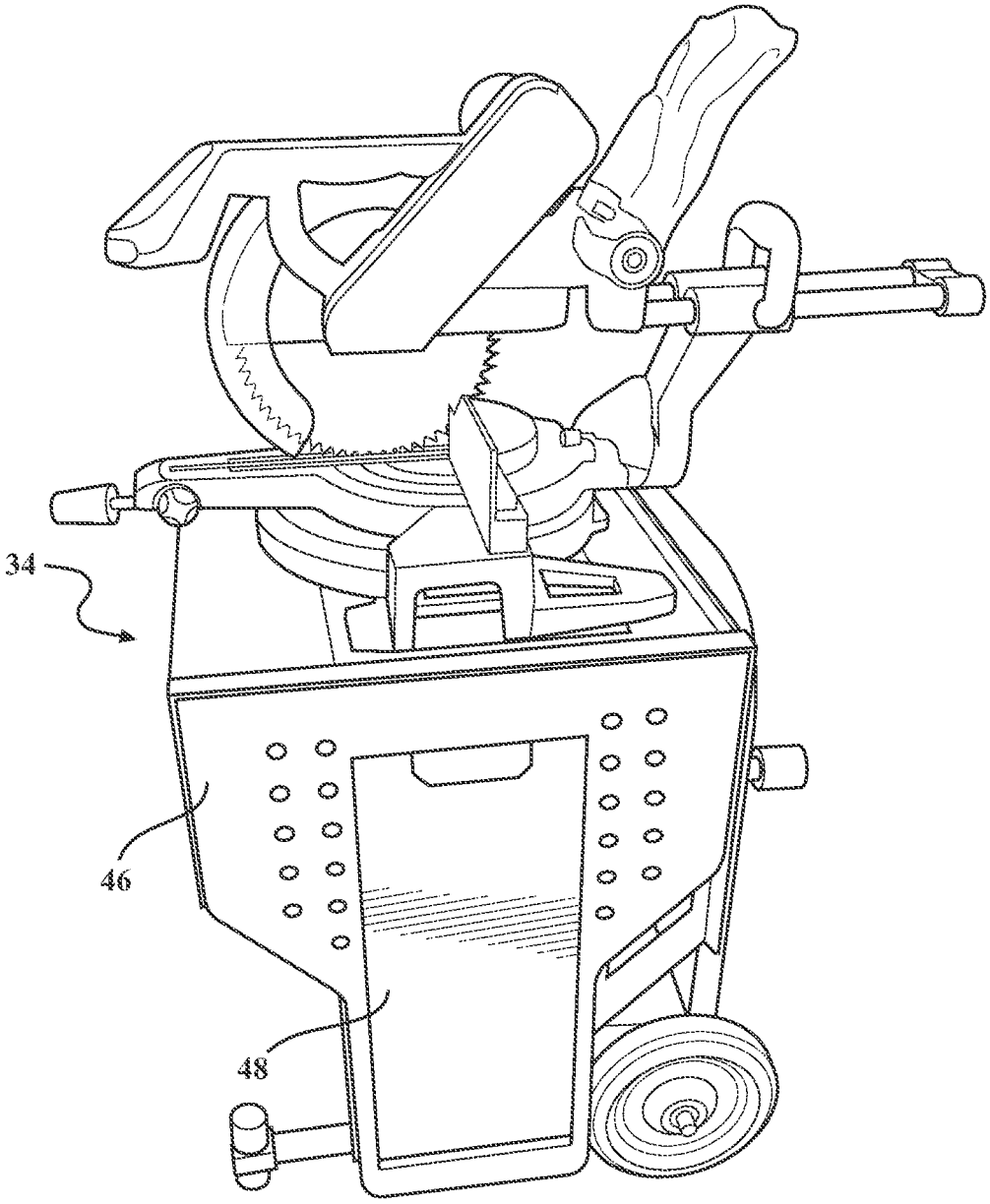
FIG. 5 is a perspective view of the tool support table of the present invention in the use position.

The table 30 can be rotated to a storage position, see FIG. 1, and a use position, see FIG. 5. The table 30 is locked in placed with a latch mechanism 60. The latch mechanism 60 includes a handle 62 extending through the top of one of the sides 12 Or 14. The side has a slot 61 to allow access to the handle 62. The latch 60 is connected to a control disc 64 form which locking rods 66 extend. The locking rods 66 extend along the length of the sides to the front and back. The locking rods 66 connect to pins 68. The pins 68 engage slots in the table 30 to lock the table 30 in place. As disclosed, the pins are spring loaded to facilitate locking.

Figure 6:
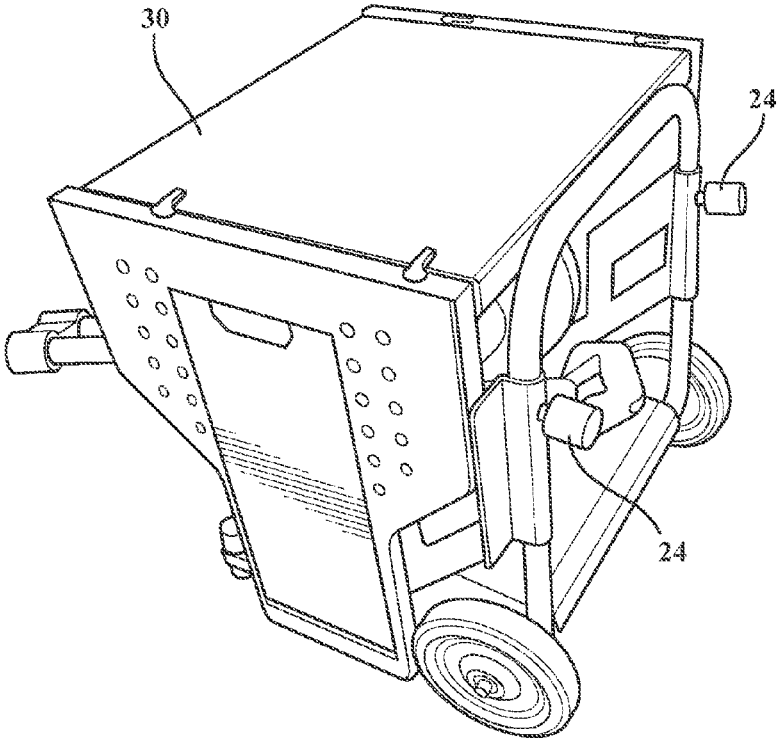
FIG. 6 is a perspective view of the tool support table of the present invention in the storage position.

With reference to FIG. 5, wing supports or side arms 46 are mounted to the opposed sides 12 and 14. The side arms 46 are mounted to rotate from a lowered position to a raised position see FIGS. 5 and 6. The side arms 46 include a height adjustable secondary platform 48. The platforms 48 are mounted upon a parallelogram having four arms 50. In this way, the platform 48 is always parallel to the arm 46. The arms 46 have ratchet connections to allow them to rotate and be fixed at selected positions. In this way, the platform 48 can be rotated to a position parallel with the surface of the tool. The platform 48 provides an extended work support platform.

As illustrated, the arms 46 include supports 50. The supports 50 in the disclosed embodiment fold when the side arms 46 are folded down. When raised, the side arms 46 pull the supports 50 to a locked position. A latch is also provided on each side arm 46 to latch the side arms in the raised position. It should be appreciated that other supports 50 could be used, for example a telescoping support.

Figure 3:
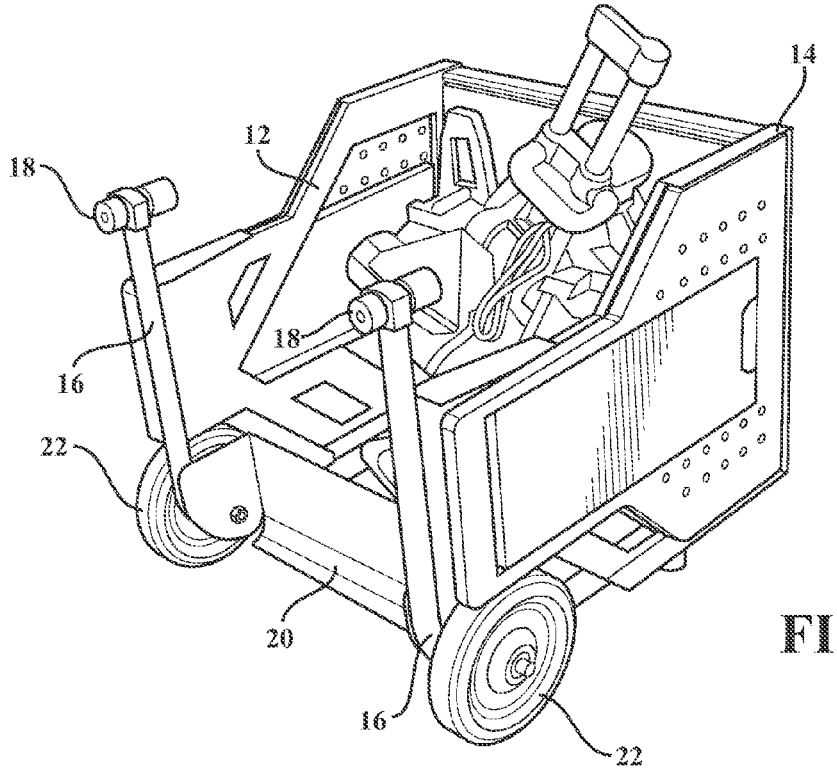
FIG. 3 is a perspective view of the tool support table of the present invention in the storage position resting on the back supports.

With reference to FIG. 1, the table 10 is shown in the storage position. As discussed above, in this position, the table 10 can be used as a worktop 32. It can also be used as an extension to a worktable. With reference to FIG. 3, the table 10 is shown in a further storage position. In this position, table 10 has been rotated to rest upon the back support tubes 24 and the stops 26. In this position, the overall height of the table 10 is less, allowing for storage under a worktable for example.

Figure 7:
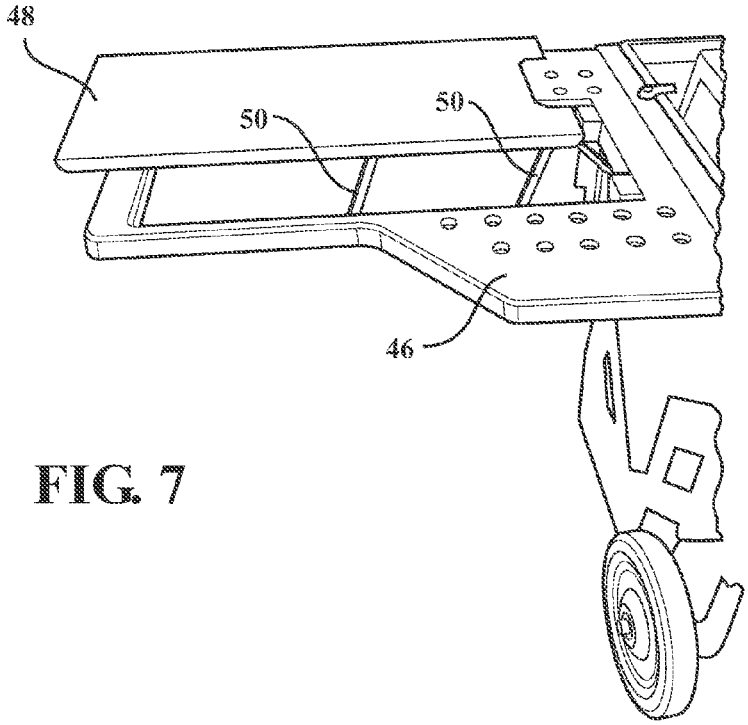
FIG. 7 is a perspective view of the tool support table of the present invention in the use position with the side arms rotated to the use position and the platforms raised.
Figure 8:
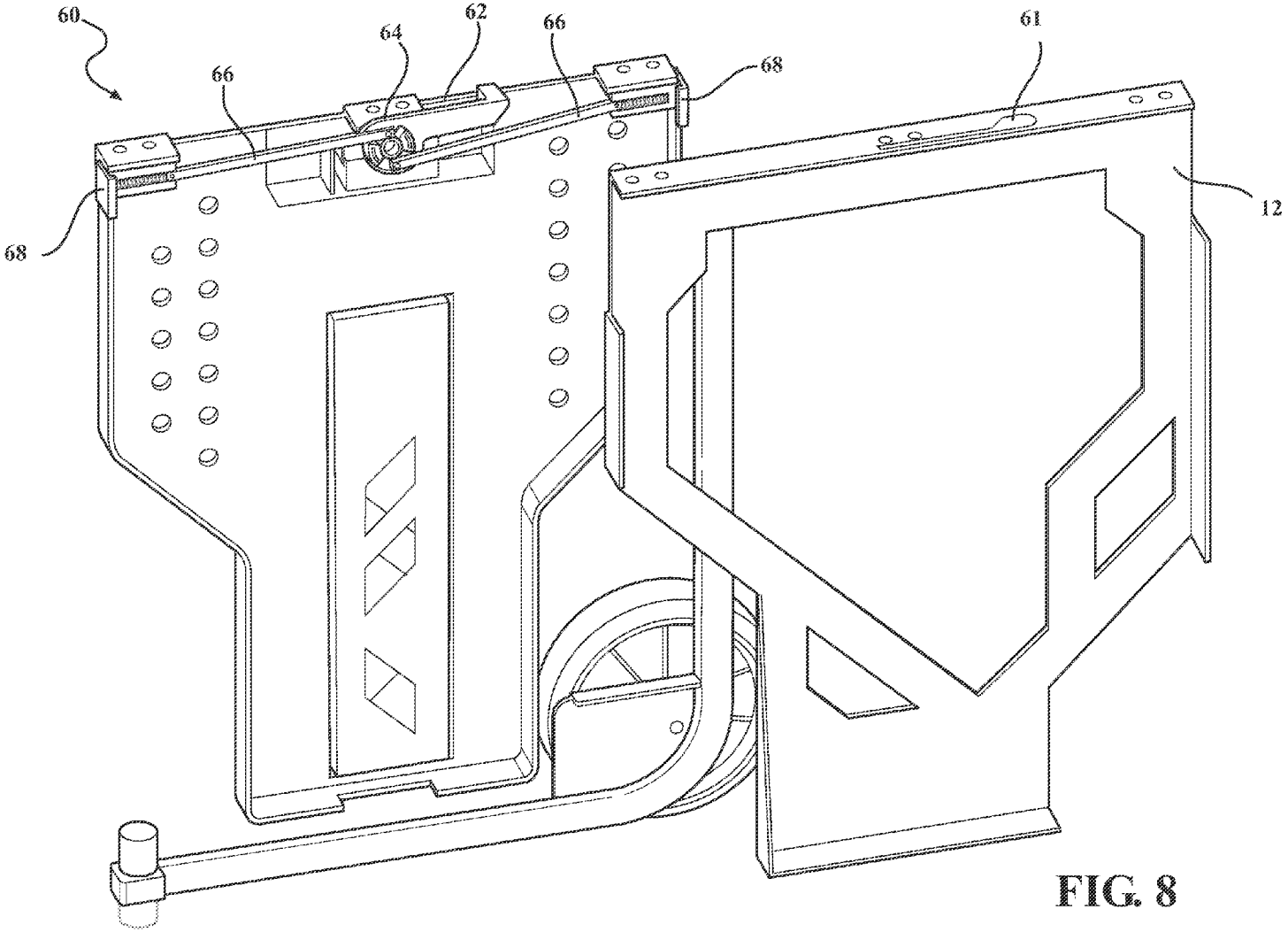
FIG. 8 is a perspective view of the latch mechanism of the tool support present.

With reference to FIG. 5, the table 10 is shown in the use position. In this position, a tool, such as a miter saw, is mounted to the tool support 34. As will be appreciated, the work surface 30 is rotated from the storage position to the use position. With reference to FIG. 7, the side arms 46 and platform 48 are illustrated.

The foregoing invention has been described in accordance with the relevant legal standards, thus the description is exemplary rather than limiting in nature. Variations and modifications to the disclosed embodiment may become apparent to those skilled in the art and do come within the scope of the invention. Accordingly, the scope of legal protection afforded this invention can only be determined by studying the following claims.

What is claimed is:

1. A work and storage table comprising:

a support frame having opposed sides;

a two sided work top mounted between said opposed sides of said support frame for rotation with respect to said support frame;

said work top having a flat surface on one side and a tool support surface on the opposite side, said work top being rotatable with respect to said support frame to expose said flat surface or said tool support surface;

said work and storage table having a generally cuboid shape;

said work top is locked in placed with a latch mechanism having a control disc from which locking rods extend and connect to pins which engage slots in the work top, whereby said work top can be rotated and locked to expose said flat surface or said tool support surface.

2. The work and storage table of claim 1, wherein said frame includes a rear lower brace and lower support tubes.

3. The work and storage table of claim 2, further including wheels mounted to the lower brace at the opposed sides, and stops to support the table in the upright position.

4. The work and storage table of claim 2, further including opposed back support tubes, each said back support tubes join a respective one of the lower support tubes forming one single generally L-shaped tube.

5. The work and storage table of claim 1, wherein said latch mechanism includes a handle extending through said support frame, said handle being connected to said control disc such that said locking rods can be controlled from one locking handle.

6. The work and storage table of claim 5, wherein said locking rods extend along the length of said support frame.

7. The work and storage table of claim 1, further including a tool mount fixed to said tool support surface, said tool mount having at least two side walls and two tool mount slides mounted generally perpendicular to said side walls for sliding with respect to said side walls, said tool mount slides being adapted to attach to a tool and then mount to said two side walls.

8. The work and storage table of claim 7, wherein said tool mount slides can be fixed to said side walls.

9. The work and storage table of claims 1, further including side arms hinged to said opposed sides, said side arms being mounted to rotate from a lowered position to a raised position.

10. The work and storage table of claim 9, wherein said side arms include a height adjustable secondary platform, said secondary platform being mounted upon a parallelogram such that said platform remains generally parallel when adjusted.

* * * * *